United States Patent [19]

Dumez

[11] 4,381,693

[45] May 3, 1983

[54] MILITARY EQUIPMENT COMPRISING A TURRET CARRYING AN EXTERNAL LARGE CALIBER GUN

[75] Inventor: Raoul H. Dumez, Sainte Adresse, France

[73] Assignee: Hispano-Suiza, Saint Cloud, France

[21] Appl. No.: 171,100

[22] Filed: Jul. 22, 1980

[30] Foreign Application Priority Data

Jul. 27, 1979 [FR] France ..... 79 19401

[51] Int. Cl.[3] ..... F41F 23/06

[52] U.S. Cl. ..... 89/36 K; 89/46; 89/47

[58] Field of Search ..... 89/45, 46, 47, 33 A, 89/33 B, 36 H, 36 K, 40 B

[56] References Cited

U.S. PATENT DOCUMENTS

| | | | |
|---|---|---|---|
| 2,790,356 | 4/1957 | Gerdin | 89/33 B |
| 2,933,981 | 4/1960 | Anderson et al. | 89/45 |
| 3,101,647 | 8/1963 | Greene | 89/46 |
| 3,581,621 | 6/1971 | Bauer | 89/36 H |
| 3,724,324 | 4/1973 | Zielinski | 89/45 |
| 4,144,797 | 3/1979 | Berge et al. | 89/46 |
| 4,313,363 | 2/1982 | Schreckenberg | 89/46 |

FOREIGN PATENT DOCUMENTS

| | | | |
|---|---|---|---|
| 1428746 | 10/1973 | Fed. Rep. of Germany . | |
| 314965 | 2/1934 | Italy | 89/47 |
| 179947 | 7/1962 | Sweden | 89/46 |
| 548005 | 4/1974 | Switzerland . | |
| 200 | of 1888 | United Kingdom | 89/36 K |
| 1157234 | 7/1969 | United Kingdom . | |

*Primary Examiner*—Stephen C. Bentley
*Attorney, Agent, or Firm*—Larson and Taylor

[57] ABSTRACT

A turret assembly, particularly for an armoured vehicle, comprises a rotating turret provided with side members projecting upwardly. The side members straddle a large caliber gun and include bearing means defining an elevation axis for the gun. The gun has a shield which cooperates with the side members to define a protective passage for a gun loading conveyor. The conveyor is adapted to carry shells one at a time from a loading station inside the turret to a location inside the shield. Each shell in turn is rammed into the gun after it has been carried by the conveyor into the shield.

11 Claims, 12 Drawing Figures

MILITARY EQUIPMENT COMPRISING A TURRET CARRYING AN EXTERNAL LARGE CALIBER GUN

BACKGROUND AND SUMMARY OF THE INVENTION

The invention relates to military equipment of the type comprising a turret mounted on a mount for rotation about a vertical axis and a main gun carried by the turret through bearing means defining an axis of rotation transverse to said vertical axis for said gun which is located out of the turret and provided with shielding means. An aiming and control system actuatable from inside the turret allows azimuth aiming of the weapon by rotating the turret and elevational aiming thereof by causing the weapon to pivot about the axis of its bearing means.

In most prior art military equipments including a large caliber main gun carried by a turret, the trunnions of the weapon are located above the front part of the raceway of the bearing supporting the turret. Then the rear part of the weapon may be located inside the turret. That arrangement has a number of drawbacks. The space taken up by the turret and its weight are directly related to the characteristics of the main weapon; the circle swept by the end of the barrel of the weapon is directly related to the length of this latter and considerably exceeds the dimensions of the carrier vehicle in most cases. The disadvantages of this conventional arrangement have made it difficult up till now to install a gun of great length on the turret of a light armoured vehicle.

In another prior art arrangement (Anderson et al. U.S. Pat. No. 2,933,981) the two trunnions of a weapon consisting of a rocket launcher are supported by bearings to define an elevation axis located rearwardly of the vertical axis of the turret. Then the overall size of the system is smaller than that of a conventional system. However there remains the problem of loading the weapon. As described in U.S. Pat. No. 2,933,981 there is provided a fully automatic loader using a belt feed in a breech secured to the launcher. That approach cannot be used when the weapon is a large caliber gun whose ammunition has a weight which requires handling it round per round. The ammunitions are not shielded to a sufficient extent. The feed belt can be loaded in a specific position only.

It is an object of the invention to provide improved military equipment of the above mentioned type. It is another object to provide an equipment which overcomes the disadvantages of conventional turrets fitted with a weapon of large caliber while ensuring at the same time the protection of and the supply of rounds of ammunition in a simple way.

According to the invention, there is provided a military equipment wherein the bearing means cooperate with the shield of the gun to define a protected supply passage for a loading system designed to supply rounds of ammunition to the gun from inside the turret in succession.

In this respect, it should be kept in mind that loading systems have been in use since a number of years in which a support for a gun defines a path for the ammunition (German Pat. No. 1 947811 for instance). However such systems are only for light weapons receiving bands of ammunition.

To the best of applicant's knowledge, it has never been suggested to associate such a system with heavy guns. That failure of the art may easily be understood: it looks like delivering individual rounds of ammunition whose weight exceeds some kgs to a gun whose elevation varies in a large range from a stationary location in the turret is not feasible.

The invention is of particular advantages when used in the field of armoured military land vehicles having a turret carrying a heavy main weapon, with loading shot by shot, and possibly a secondary armament (typically a machine gun). This application is however not exclusive: the invention may also be used on a pill box or a sea vessel.

Whatever the application, advantages of the invention clearly appear. The circle swept by the end of the barrel of the weapon is reduced because the pivots are transferred from the front to the rear of the turret. The dimensions of the latter may be reduced, particularly because the inner diameter of its raceway does not have to accommodate the recoil distance of the weapon with respect to the pivot. The range of positive and negative elevation is increased. The dimensions of the turret body have no longer to be determined to accomodate the rocking and recoil movement of the rear part of the weapon: it is sufficient for the turret to receive the gunner or the gunners and the ammunition.

To the structural advantages are added ergonomic advantages: since the weapon does not project into the compartment occupied by the gunners, the movements of the latter are easier, the space available is greater, there are no longer empty shells in the turret, the combustion gases flow out of the turret when the breech is opened, the noise in the turret during firing is reduced.

Finally, the protection of the vehicle and the gunners is very much improved: the turret may be conceived so as to have low streamlining; it is possible to fire from a firing ridge while exposing neither the vehicle, nor the occupied space of the turret. The unit formed by the weapon and its armour plating has itself a small front and side surface and is less exposed to destruction by hostile fire.

The main weapon carried by the turret will typically be a gun of large caliber, typically 81 mm and more, whose loading takes place shot by shot. The armour of the weapon will surround the rear part thereof, up to and including the pivoting axis, and will provide at the rear the space required for recoil. The shells may escape through a rear opening in the armour. To provide a path for the rounds of ammunition, the armour of the weapon will typically comprise a front wall in the form of a cylindrical sector centred on the pivoting axis of the gun and in which there is provided an opening through which passes the supply system (chain conveyor for example), said opening cooperating with an associated part of one of lateral supports fast with the turret.

To reduce the torques required for aiming the weapon in elevation, the pivoting axis is advantageously placed so that it is near the centre of gravity of the unit formed by the weapon and its armour; a mechanical system exerting resilient forces may be provided for balancing the residual pivoting torque.

The invention will be better understood from the description which follows of particular embodiments, given by way of examples. The description refers to the accompanying drawings.

SHORT DESCRIPTION OF THE DRAWINGS

FIGS. 1 and 2 are simplified diagrams showing a first embodiment, respectively in elevation and from the front;

FIGS. 3 and 4, similar to FIG. 1, show modified embodiments;

Figure 10A:
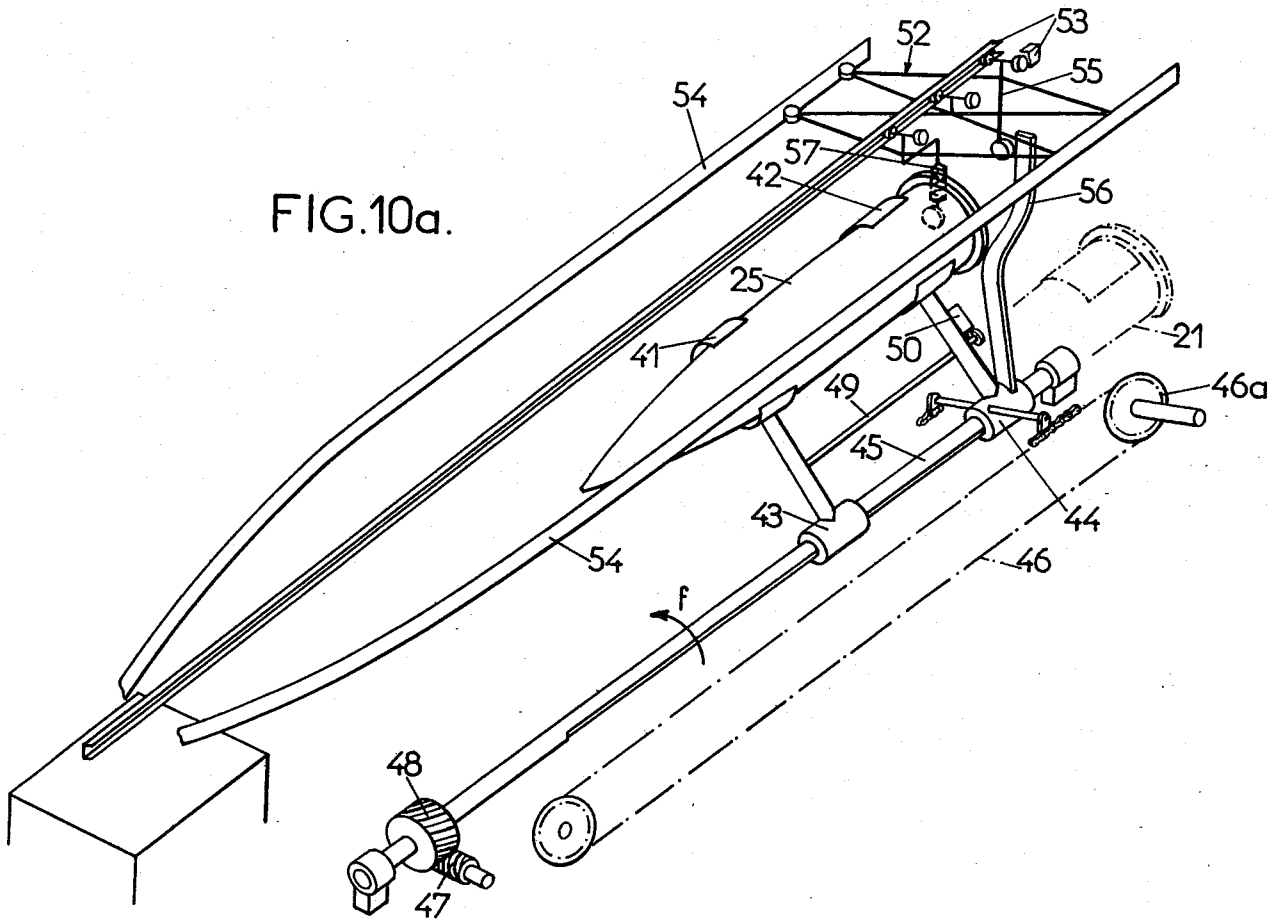
Figure 10B:
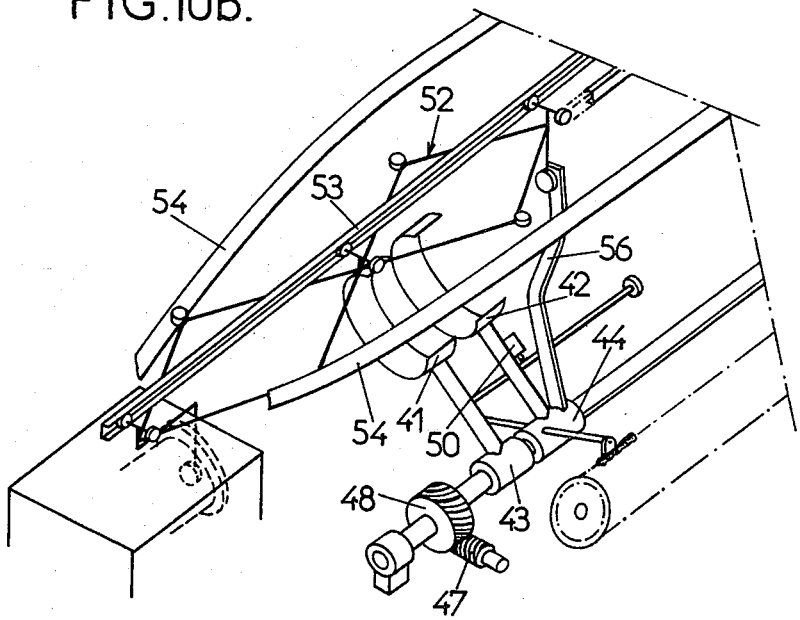
Figure 11:
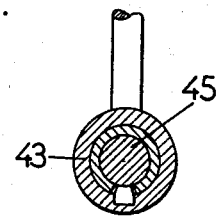

FIGS. 10*a* and 10*b* illustrate a possible construction of that part of the system which is directly associated with the gun;

FIG. 11 illustrates a detail of FIG. 10*a*.

DETAILED DESCRIPTION OF PREFERRED EMBODIMENTS

Figure 1:
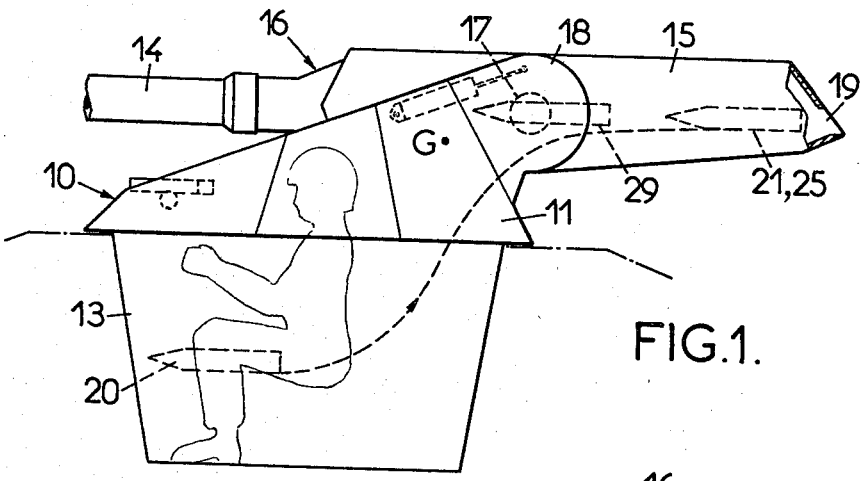
Figure 2:
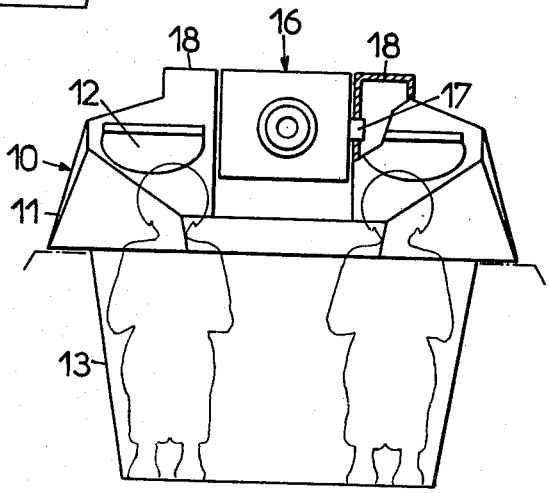

Referring to FIGS. 1 and 2, there is shown an equipment having a turret 10 which will be assumed supported by a vehicle whose chassis is delineated in dash-dot lines. A vertical axis large diameter bearing (not shown) is located between the turret and the chassis. Turret 10 comprises an armoured cupola 11 which will generally be provided with access panels 12 (FIG. 2) and a personnel compartment 13 situated inside the vehicle. Turret 10 carries an outside weapon of large caliber 14, constituted by a gun whose rear part is provided with armour plating 15 and which forms therewith a unit 16. Unit 16 rotates with the turret as a whole. It is supported by pivotal bearing means with horizontal axis allowing the weapon to be aimed in elevation by means of power means controlled by a device situated inside the turret, schematized by a jack. In the embodiment illustrated, unit 16 is so located that the firing axis of weapon 14 intersects the rotational axis of the turret.

The pivotal bearing means comprises two lateral supports 18 straddling unit 16 and trunnions 17 fast with the cradle of the weapon 14 and shield 15. Supports 18 are hollow and trunnions 17 bear on their internal or external side wall, as the case may be. Support 18 and trunnions 17 are placed so that the elevation axis of unit 16 is situated behind the rotational axis of the turret. In the embodiment illustrated in FIGS. 1 and 2, the elevation axis is practically situated above the rear part of the bearing supporting turret 10. With this arrangement, the overall space taken up by the turret and the volume of the compartment may be very substantially reduced with respect to that required by a conventional arrangement. The shield 15 of the weapon, provided with inspection and access doors to the weapon and its loading device (not shown), is provided with a rear opening 19 for ejecting empty shells during firing.

The equipment comprises a system for supplying and loading weapon 14 with ammunition along a path entirely under armour. The path of the ammunition rounds, whose weight will be several kilograms or even tens of kilograms, extends from an initial station 20 inside compartment 13 to a loading station, situated within the shield. The supply system comprises a conveyor, for example a chain conveyor of conventional type, for bringing each round of ammunition in turn from station 20, on which the ammunition is placed by the gunner, to a transfer station 21 offset laterally from the vertical midplane of weapon 14, located rearwardly of the weapon and from where the round can be moved laterally to a loading station 25 placed along the axis of the weapon. The round may be rammed into the breech after recoil of the weapon, which may be used to mechanically energize the ramming means, which will only be triggered off after ejection of the empty shell and arrival of a fresh round of ammunition. Finally, the round takes up position 29, ready for firing.

The ramming means may also be separate and energized by mechanical, electrical or hydraulic power means.

It will be appreciated that the loading system is entirely protected while it extends from inside cupola 11 to inside shield 15, since it passes through openings provided in a part cylindrical wall of support 18 and a corresponding wall of shield 15.

Figure 3:
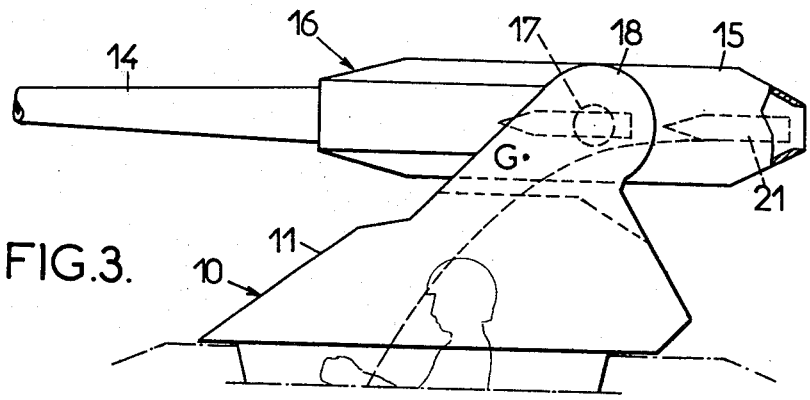

In the modified embodiment shown in FIG. 3 (where the parts corresponding to those already shown in FIG. 1 are designated by the same reference number), the offset of trunnions 17 rearwards with respect to the rotational axis of the turret is smaller than in FIG. 1, while remaining nevertheless appreciable since it is greater than half the radius of the bearing ring. On the other hand, the height of trunnions 17 above the bearing raceway is very much increased, by increasing the height of supports 18, which allows in particular greater positive elevation angles to be reached. It can be seen that the height of trunnions 17 above the bearing represents practically two-thirds of the diameter of the bearing.

Figure 4:
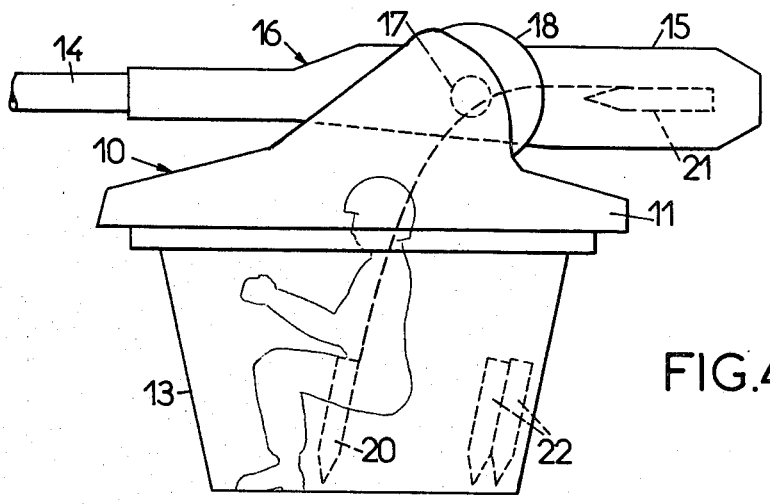

In the modified embodiment shown in FIG. 4, the supply system of the weapon moves the ammunition rounds along a slightly different path from that shown in FIGS. 1 to 3: the gunner takes a round of ammunition stored at 22 and places it on the loading conveyor at 20.

Figure 5:
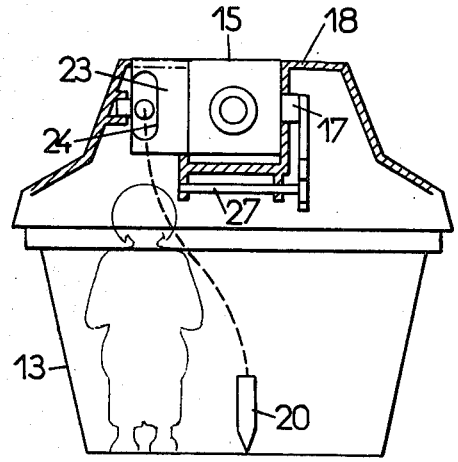
FIGS. 5 and 6 are diagrammatic cross-sections, respectively through a plane passing through the horizontal pivoting axis and through a vertical plane perpendicular to this axis of a mechanical system for balancing the weapon.
Figure 7:
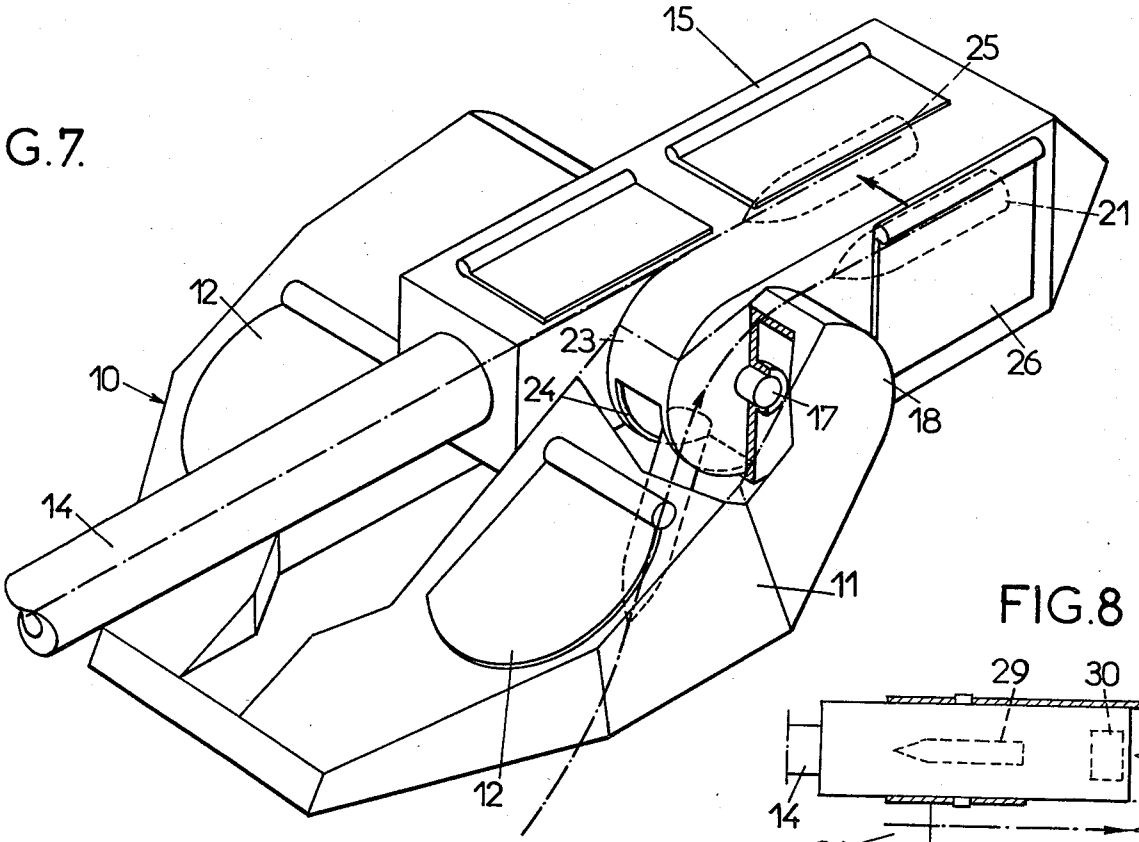
FIG. 7 is an isometric diagrammatic view of the armour and of a support designed to define a passage for the ammunition supply system.
Figure 8:
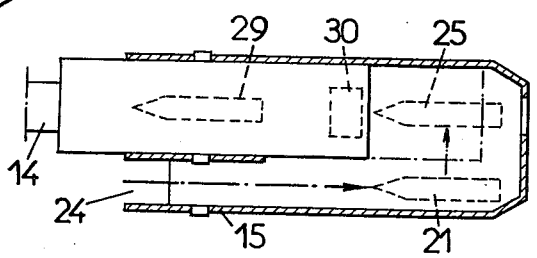
FIG. 8 is a diagram on an enlarged scale showing the recoil of the breech (dashed zone) and its role in loading, as seen from above.

In all cases, the conveyor passes through one of supports 18 and a mating surface unitary with shield 15. The arrangement may for instance be as shown in FIGS. 5, 7 and 8. Shield 15 comprises a partcylindrical wall 23 centred on the elevation axis and in which there is provided an opening 24 for the conveyor. Wall 23 cooperates with a corresponding wall of cupola 11 of mating shape, also having an opening for the conveyor. The angular extent of opening 24 is sufficient to allow loading in the whole range of elevational aiming envisaged. So that no fraction of the opening opens outwardly, even at the maximum positive elevation, the lateral support through which the supply system passes may be completed by a partcylindrical shield member (not shown). Referring to FIG. 7, the path of a round of ammunition through support 18 to transfer station 21 is indicated by arrows. From station 21 the round is transversely moved. In FIG. 7, flaps 26 for access to the breech of the weapon and to the loading system are placed in proper relation to the weapon.

During firing, the loading device is retracted and clear of the recoil path. The breech block 30 is freed on firing, the breech recoils along with the block and the empty shell is ejected rearwards. The loading system will then introduce a fresh round of ammunition. The weapon is then back to the firing position and the conveyor again enters into action to move a round of ammunition to 21.

Figure 6:
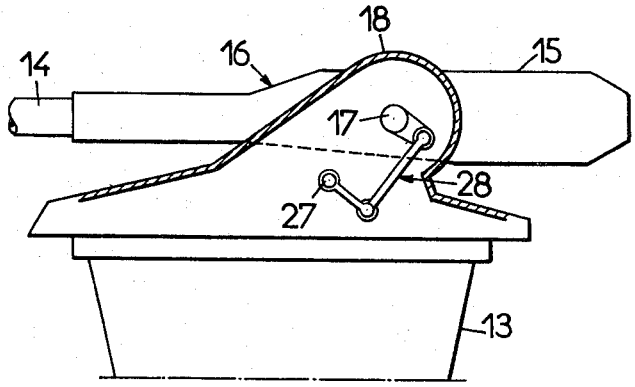

The trunnions 17 are advantageously placed on the pivoting unit 16 at a location which defines an axis close to the centre of gravity G of the unit. Thus the gravity torques which the elevation aiming device must overcome are reduced. In order to reduce them further, a mechanical system may be provided exerting resilient forces which balance out, at least partially, the gravity torque on unit 16. In the embodiment illustrated in FIGS. 5 and 6, it comprises a torsion bar 27 connected by a linkage 28 to trunnions 17. The linkage typically comprises cams (not shown). The balancing system may assume other forms and may use any resilient return members, such as torsion bars or helical springs.

Figure 9:
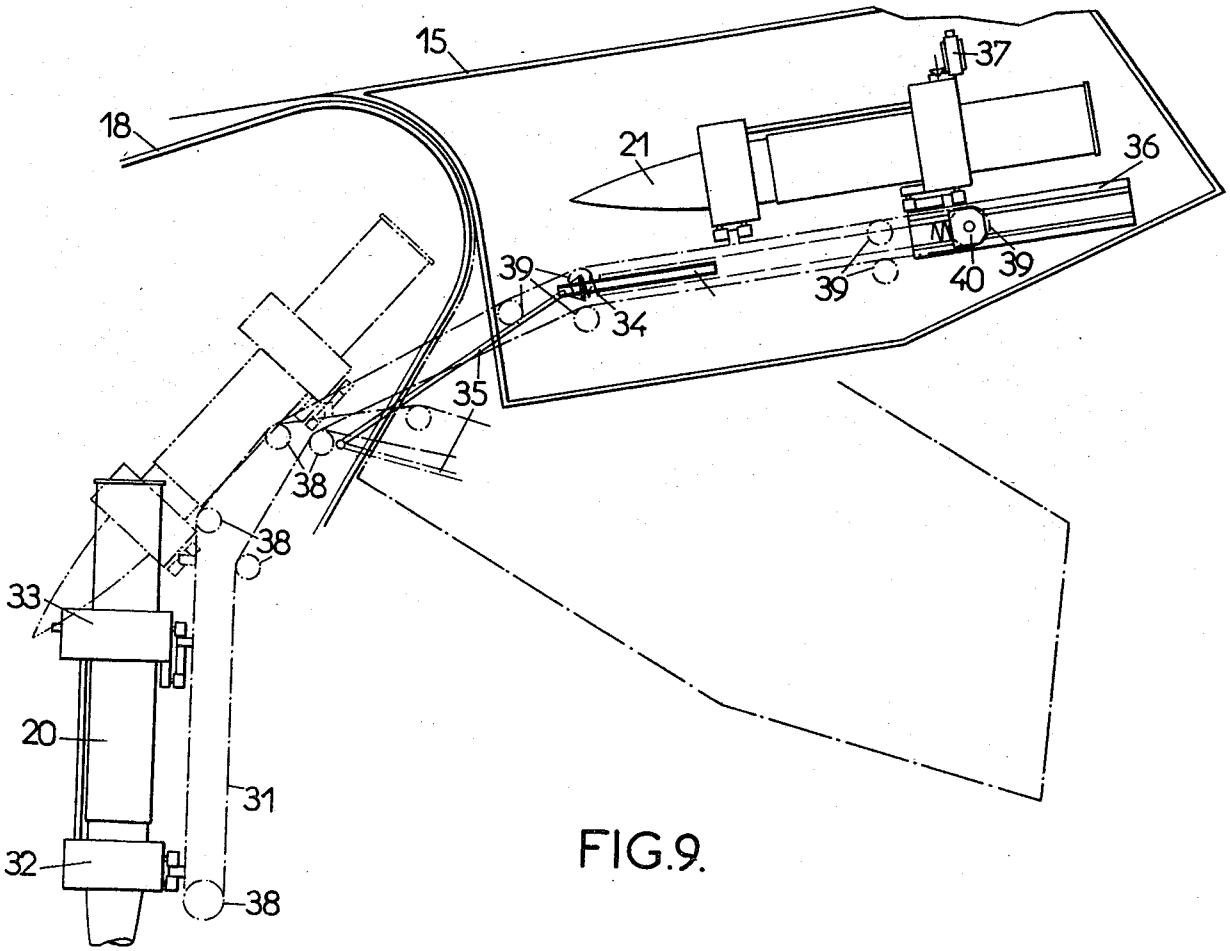
FIG. 9 is a cross-sectional view along a vertical plane of an ammunition supply system according to the diagram of FIG. 8.

Reference will now be made to FIGS. 9 to 11, which illustrate a particular supply system according to the diagram of FIGS. 7 and 8 more precisely. The system as shown in FIGS. 9–11 (where the components already shown in FIGS. 7 and 8 are designated by the same reference numbers) may be regarded as comprising a conveyor for carrying one round of ammunition at a time from the initial station 20 (where it is manually located by the gunner) to the transfer station 21 and then to the loading station 25, and a ram device for forcing the round from station 25 into the firing chamber, inside the breech.

The loading conveyor may be considered as consisting of a travel mechanism and a transfer mechanism.

The travel mechanism moves the round from 20 to 21. It comprises a chain drive having two parallel endless chains 31 driven by a motor unit (not shown) which may be entirely conventional. Supporting clamps 32 and 33 secured to chains 31 are connected together and constitute a cradle on which the gunner rests the round at station 20.

The chains 31 are guided and driven through rollers and sprockets. Some of them, designated 38, are located in and supported by the turret assembly. The other are located in the compartment defined by the shield 15 and carried by the shield.

The rollers and sprockets 38 and 38 are so located that they define a clear ammunition path through the openings of support 18 and shield 15 whatever the elevation between the maximum positive angle (in dash-dot lines in FIG. 9) and the maximum negative angle (in full line).

The chains 31 should be permanently tensioned. For that purpose, the pulleys 39 are pivotally connected to a carriage 40 mounted on rails 36. Carriage 40 is subjected to the resilient force of a spring 34 compressed between carriage 40 and a rocking link 35, having an end portion rotatably connected to the turret at a fixed location and its other end movable along a path coaxial with the carriage path, inside the compartment.

The motor unit which drives the chain is associated with a control system, which may consist of a power unit, relays and end switches. That system determines the travel of the chains for clamps 32 and 33 to move from 20 to 21 a fresh round, or the reverse for reset or for bringing back a round which was not fired.

The transfer mechanism is designed to bring the round from the transfer station 21, laterally offset from the gun, to the loading station. Referring to FIG. 10*a*, the transfer mechanism comprises a pair of clamps or yokes 41 and 42 which may be similar to clamps 32 and 33. Each clamp 41 and 42 is securely connected by a radially directed rod to a sleeve 43 or 44 slidably non rotatably connected to a shaft 45 (FIG. 11). A power mechanism associated with sleeve 44 is designed for reciprocating it between the transfer position in which it is shown in FIG. 10*a* and a front position (FIG. 10*b*). The structure and operation of that power mechanism will be described later.

A control system drivably connected to the shaft 45 may rotate it for bringing a round of ammunition from 21 to 25 (FIG. 10*a*) and back. The system may comprise an electric motor (not shown) driving an endless screw 47 in mesh with a toothed wheel 48 securely keyed on shaft 45.

The ram device for introducing the round of ammunition into the firing chamber of the weapon first operates the clamps 41 and 42 and then a deformable parallelogram linkage, in sequence.

As indicated above, clamp 42 is provided with means for moving it from the position in FIG. 10*a* to the position in FIG. 10*b*. In the illustrated embodiment, such means include a chain 46 which is received by a drive sprocket 46*a* drivebly connected to an electric motor (not shown). Clamps 41 and 42 constitute a cradle for transporting the round of ammunition. Clamps 41 and 42 are connected by a rod 49. An electromagnet 50 is provided for inhibiting the connection between rod 49 and the radial arm of clamp 42. The electromagnet is energized when clamp 41 has been moved to the end of its forward stroke. Continued movement of clamp 42 partially inserts the round of ammunition into the chamber.

The deformable parallelogram linkage comprises a movable unit 52 having inner rollers which cooperate with parallel rails 53 and outer rollers which cooperate with lateral rails 54 which converge towards each other in their forward portion. The rear portion of the movable unit is provided with a leg 55 cooperating with a driving leg 56 fast with sleeve 44. Thus the parallelogram linkage is driven by clamp 42 during the forward stroke of the latter. During the final portion of the forward stroke, when clamp 42 moves closer to clamp 41, the lesser distance between the lateral rails 54 results in an increase of the longitudinal size of the parallelogram linkage and complete introduction of the round into the chamber by a spring push rod 57.

The device further includes conventional components, such as switches which open or close at the beginning or at the end of the stroke of the components, relays and manually actuatable control switches.

Since operation of the system is clearly apparent from its construction, it will only briefly described.

After the gunner has located a round of ammunition at the initial station 20 and triggered operation of the system, the chains 31 are moved and bring the round to the transfer station 21. An end switch then energizes solenoids associated with clamps 41 and 42 for the clamp to grip the round. Clamps 32 and 33 may then be opened, for instance by de-energization of associated solenoids 37. The power means associated with shaft 45 are then actuated to rotate the shaft and transversely move the round of ammunition from station 21 to station 25 (arrow f in FIG 10*a*). The driving means associated with sleeve 44 are then energized for successively moving clamps 41 and 42 as a whole and then moving clamp 42 by an additional amount and simultaneously increasing the length of the parallelogram linkage for introducing the ammunition. Clamps 41 and 42 are then moved back to their initial position and clear the space necessary for the recoil upon firing. The shell is ejected through opening 19 (FIG. 1) and the gun may be loaded again.

I claim:

1. Military equipment comprising: a turret mounted on a mount for rotation about a substantially vertical axis; a pair of side members secured to said turret and projecting upwardly therefrom; bearing means carried by said side members and defining an elevation axis transverse to said vertical axis; a main gun of a caliber greater than that suitable for belt feed of ammunition and located out of and above said turret, carried by said bearing means and provided with a separate shield unitarily connected to said gun, said bearing means cooperating with the shield of the gun to define a protected passage; and a gun loading system, at least a portion of which is located in said protected passage, arranged to carry one round of ammunition at a time from a predetermined location inside the turret and to insert said round into a firing chamber of said gun, said loading system being arranged to accomodate the variations in elevation, the shield of said gun including a front wall located on one side of the gun in which there is provided an opening for said loading system whose angular extent is sufficient to allow loading in the whole range of elevation aiming of the gun.

2. Military equipment according to claim 1, wherein the shield of the gun comprises a front wall in the form of a cylindrical sector centred on the elevation axis, located on one side of the gun, in which there is provided an opening for said loading system, whose angular extent is sufficient to allow loading in the whole range of elevation aiming of the gun.

3. Equipment according to claim 1, wherein the bearing means are placed on the shield of the gun in a position such that the centre of gravity of the pivoting unit consisting of the gun and shield is situated close to the elevation axis and resilient means are provided for balancing at least partially the torque due to gravitational forces tending to pivot the gun.

4. Equipment according to claim 1, wherein the shield of the gun is provided with a rear opening for ejection of the shells rearwardly of a compartment in the shield.

5. Equipment according to claim 1, wherein said loading system comprises a chain conveyor, adapted to successively bring rounds of ammunition one by one from an initial station in the turret to a transfer station provided in said shield and offset laterally from the median vertical plane of the gun, and means for transversely displacing one round at a time from said transfer station to a loading station placed along the axis of the gun and behind the breech thereof.

6. Equipment according to claim 5, wherein said loading system includes a transfer mechanism for transfer of an individual round of ammunition from said transfer station to said gun, said transfer mechanism having:

clamping means slidably non-rotatably connected to a drive shaft and adapted to seize said individual round of ammunition at said transfer station, means for unitarily rotating said shaft and clamping means to the extent necessary to move said individual round from said transfer station to said loading station, and ram means for moving said clamping means axially toward the breech of the gun.

7. Equipment according to claim 6, wherein said ram means include a deformable parallogram linkage drivably connected to said clamping means and arranged to have an abutting connection with said individual round of ammunition whereby it rams it into a firing chamber of the gun from the position to which the round is brought by said clamping means.

8. Equipment according to claim 1, wherein said loading system is energized by separate power means.

9. Equipment according to claim 1, wherein said loading system is arranged to be moved clear of the gun after loading so as to allow recoil of the latter.

10. Equipment according to claim 1, wherein the distance between the elevation axis and the vertical axis of the turret is such that the circle swept by the end of the barrel of the gun during rotation of the turret approaches the minimum for a predetermined overall length of the gun and the shield.

11. A turret assembly for an armoured land vehicle comprising:

a turret mounted on said vehicle for rotation about a substantially vertical axis and arranged to accommodate crew members, means inside the turret for storing individual rounds of ammunition of a predetermined caliber at a plurality of locations reachable by one of the crew members, a loading station inside the turret reachable by said one of the crew members for receiving said individual rounds one at a time, a gun of said caliber located out of and above said turret and of a type having a breech for shot by shot loading with said rounds of ammunition, a shield for said gun separate from said turret, enclosing said breech and securely connected to said gun, a pair of side members securely connected to said turret, projecting upwardly from said turret and defining bearing means supporting said shield and gun for rotation about an elevation axis transverse to said vertical axis and rearwardly thereof, said side members being constructed and arranged to define in cooperation with said shield a protected passage from said loading station to the inside of said shield, and a gun loading system including a chain conveyor extending along said protected passage and arranged to supply rounds of ammunition one at a time to the breech of the gun from said loading station, said chain conveyor being arranged to accommodate the elevation variations of the gun, the shield of said gun including a front wall located on one side of the gun in which there is provided an opening for said loading system whose angular extent is sufficient to allow loading in the whole range of elevation aiming of the gun.

* * * * *